US009420859B2

(12) United States Patent
Bourette

(10) Patent No.: US 9,420,859 B2
(45) Date of Patent: Aug. 23, 2016

(54) EXPANDABLE LUGGAGE

(71) Applicant: Arthur Trey Bourette, Palm Bay, FL (US)

(72) Inventor: Arthur Trey Bourette, Palm Bay, FL (US)

(73) Assignee: Arthur Trey Bourette, Palm Bay, FL (US)

( * ) Notice: Subject to any disclaimer, the term of this patent is extended or adjusted under 35 U.S.C. 154(b) by 79 days.

(21) Appl. No.: 14/016,456

(22) Filed: Sep. 3, 2013

(65) Prior Publication Data

US 2015/0060221 A1 Mar. 5, 2015

(51) Int. Cl.

| | |
|---|---|
| ***A45C 7/00*** | (2006.01) |
| ***A45C 5/14*** | (2006.01) |
| ***A45F 3/04*** | (2006.01) |
| *A45C 13/26* | (2006.01) |
| *A45C 9/00* | (2006.01) |
| *A45F 4/02* | (2006.01) |

(52) U.S. Cl.

CPC ..... *A45C 5/14* (2013.01); *A45C 7/0068* (2013.01); *A45F 3/04* (2013.01); *A45C 2009/007* (2013.01); *A45C 2013/267* (2013.01); *A45F 2004/023* (2013.01)

(58) Field of Classification Search

CPC ..... A45C 5/14; A45C 7/0068; A45C 7/00; A45C 2003/007; A45C 2009/107; A45C 2013/267

USPC ..... 190/18 A, 103, 115, 104, 105, 39

See application file for complete search history.

(56) References Cited

U.S. PATENT DOCUMENTS

| | | | | |
|---|---|---|---|---|
| 4,773,515 | A * | 9/1988 | Kotkins, Jr. | 190/103 |
| 4,830,154 | A * | 5/1989 | Gerch et al. | 190/103 |
| 5,664,652 | A * | 9/1997 | Shamah | 190/18 A |
| 5,819,891 | A * | 10/1998 | Wang | A45C 13/262 16/429 |
| 6,179,101 | B1 * | 1/2001 | Lin | A45C 13/262 190/103 |
| 6,592,012 | B2 * | 7/2003 | Godshaw et al. | 224/153 |
| 6,776,271 | B2 * | 8/2004 | Chen | A45C 13/30 190/107 |
| D509,360 | S * | 9/2005 | Cassegrain | D3/289 |
| 7,575,376 | B2 * | 8/2009 | Yu | 383/2 |
| 7,975,816 | B1 * | 7/2011 | Lin | 190/37 |
| 2002/0139627 | A1 * | 10/2002 | Mahanavanont | 190/115 |
| 2003/0015559 | A1 * | 1/2003 | Oh | 224/153 |
| 2006/0151560 | A1 * | 7/2006 | Chen | A45C 7/0068 224/645 |
| 2007/0164064 | A1 * | 7/2007 | Nathan | 224/153 |
| 2014/0311848 | A1 * | 10/2014 | Meersschaert et al. | 190/18 A |

FOREIGN PATENT DOCUMENTS

EP 0779045 A1 * 6/1997

* cited by examiner

*Primary Examiner* — Sue A Weaver

(57) ABSTRACT

A combination "carry on" and "check in" bag in the shape of a conventional carry-on luggage or backpack and or a larger duffel bag or large luggage made of flexible material and includes handles, storage pockets, a slide handle with storage pocket, backpack straps stored in a rear compartment for use while in the backpack configuration, and various zippers and pleats to achieve the expansion and retraction of the invention. While using it as a carry on bag the zip of the zipper closes and tucks in the extra/additional bag material in its inverted position and when needed for using as a duffel bag, the zip of the zipper opens and expands the material outward to create extra space for luggage.

8 Claims, 10 Drawing Sheets

EXPANDABLE LUGGAGE

CROSS-REFERENCE TO RELATED APPLICATION

This application claims benefit of priority of U.S. Provisional Patent Application Ser. No. 61/744,365, filed Sep. 26, 2012, entitled "Xpanda Bag™ expandable luggage, expandable backpack, duffel bag, expandable bag, "check in" duffle bag and or expandable "carry on" bag, expandable sports bag, expandable activities bag", owned by the assignee of the present application and herein incorporated by reference 5 in its entirety.

FIELD OF INVENTION

Aspects of the present invention relate to an expandable bag with multiple configurations which can serve the purpose of a combination of a "carry on" small size and a "check in" large size bag. Conversion of the bag from "carry on" to "check in" or duffel bag and vice versa, basically depends on the location and function of the zip of the zipper, folds and pleats of the flexible bag material which helps in expansion and/or retraction of the bag as required according to the need of use.

BACKGROUND

Luggage is often times used by travelers and others in order to transport clothing and other items, such as, toiletries and souvenirs between locations. The available storage space within a luggage bag is normally constrained by its design limitations and the construction of the bag. Thus, travelers often times have multiple pieces or a set of luggage to suit their various needs, such as, for example, a smaller duffle for a weekend trip or a larger rolling suitcase for a longer vacation. However, it is desirable to have a single article of luggage which is expandable and collapsible to allow the user to change the interior volume and which is versatile and reconfigurable depending on the user's needs.

Expandable carrying cases are shown in U.S. Pat. No. 3,443,671. The case in this patent is provided with an expansible joint closed by an elongated zipper. When the zipper is opened, the joint can expand to increase the volume of the main storage compartment of the carrying case. Expansible carrying cases of the type shown in this patent are quite useful but are limited in their versatility.

While the prior art discloses many types of luggage, so far as is known, none of the prior art devices afford this versatility in a simple, effective and yet highly advantageous manner as does the present invention.

In a principal aspect the present invention relates to a multiple configuration bag or packs which may be utilized as a duffel bag or alternatively as a back pack/carry bag made of flexible recycled or non recycled material and includes handles, storage pockets, a slide handle with storage pocket, backpack straps stored in a rear compartment for use while in the backpack configuration, and various zippers and pleats to achieve the expansion and retraction of the invention. Further, unlike other inventions, the present invention is unique that unlike other versions of expandable bags, the current invention nominally impairs the space of the smaller carry on while the invention is in its retracted state. The bag is nominally effected by expansion material and nominally encroaches upon precious cargo space of the Xpanda bag while retracted. While, other prior art inventions take up a great amount of space making the smaller bag impractical and virtually they become a carrier for a larger bag.

SUMMARY

According to the primary aspect of the present invention a "carry on" backpack size luggage, back pack, or bag that converts to a larger "check in" size luggage, backpack, or duffel bag without need of or excess of other materials to make the conversion possible is disclosed. With the zip of a zipper, and the fold of the flexible material, the invention makes the conversion possible eliminating the need for other various products of the category. As a further feature of the present invention, several other multiple storage pockets with zippers, side access pockets, shoulder backpack straps, strap handles, slide handle and wheels for luggage dragging purpose are provided.

It is an object of the invention wherein the design of the bag provides consumer, a greater flexibility in travel and other aspects of life to carry large or small goods or belongings with one bag. It is further an object of the invention, to save money at the travel ticket counter by converting the large duffel bag to a small "carry on" bag shape and dimension when limited goods or luggage need to be carried. Alternatively, should the consumer in travel or other aspects of life require greater storage to contain goods or belongings, the bag expands to meet the larger bag requirements. This process applies to smaller or larger produced bags with the similar fold and zipper locations to create this flexibility regardless of the manufactured size and shape of the bag. The term "carry on" implies the need of the invention in its inverted format with small dimensions, to be approved by the airlines or other transportation in size and shape to be usefully carried on within the baggage allowance limit. The "carry on" size regulations may change and thus no specifications are granted. Similarly, the expanded version of the bag will be suitable for, check in without additional fees due to size or shape. Weight will be dependent on the volume of goods inside the invention and thus will not be depicted in these specifications.

It is an object of the invention to provide a combination "carry on" and duffel bag which is comprised of flexible material and which includes various pockets for storage of handles and/or straps. Additionally, the expansion material of the bag used for converting a carry on backpack to large duffel bag may be rolled, tucked, or otherwise used as a pocket as the need may be. A retaining strap may be included in the invention to retain a rolled version of the expansion material when in the unexpanded position, while a tucking pocket will be included to retain a tucked in version.

Yet a further object of the invention is to provide a combination "carry on" and duffel bag which involves safe construction, economical to manufacture, and is foldable or compressible for easy storage, and which has a large storage capacity.

Other objects, embodiments and advantages of the embodiments herein will become readily apparent from the following detailed description taken in conjunction with the accompanying drawings.

DETAILED DESCRIPTION

Figure 1:
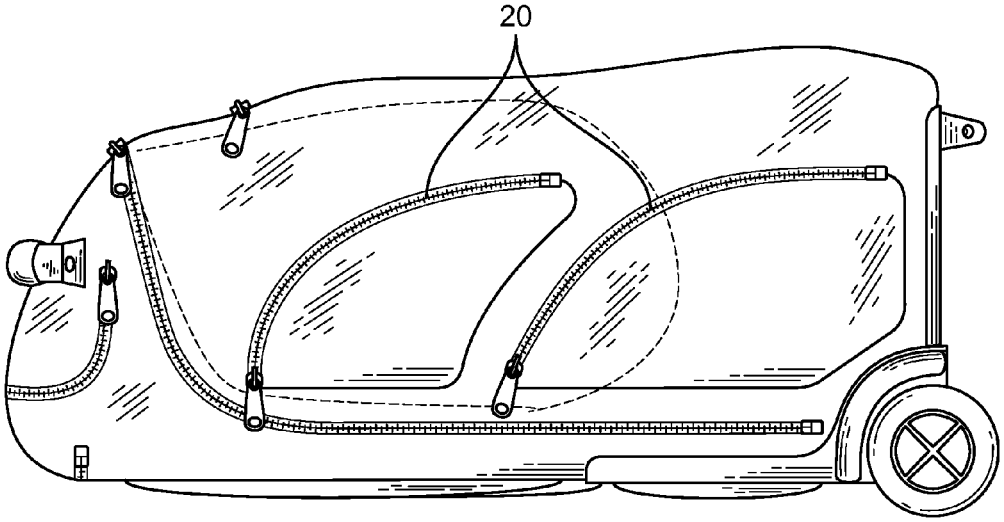
FIG. 1 Illustrates the side view of the invention (Xpanda Bag) in its "carry on" position FIG. 2 Illustrates the top view of the invention laying on its back in the "carry on" position FIG. 3 Illustrates the upper top of the invention laying on its back in the "carry on" position FIG. 4 Illustrates the bottom standing base of the invention laying on its back in the "carry on" position FIG. 5 Illustrates the back of the invention laying on its side in the "carry on" position FIG. 6 Same as FIG. 1 yet with the extension handle elongated in the carry on position FIG. 7 Illustrates the back of the invention with backpack straps shown and extension handle elongated in the "carry on" position FIG. 8 Illustrates the invention profile view while expanding or retracting the invention.
Figure 2:
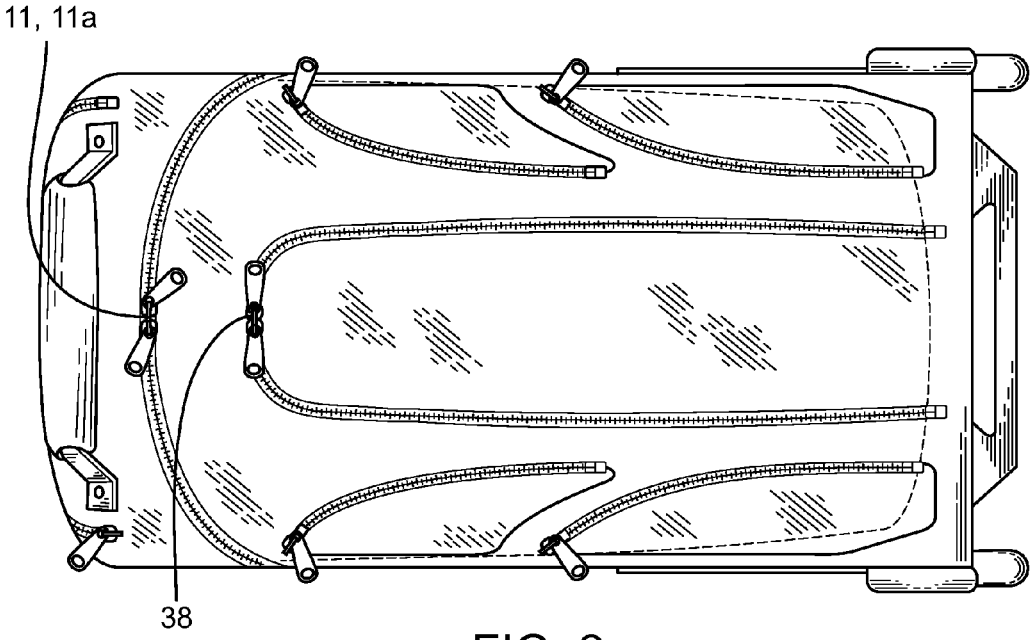
Figure 3:
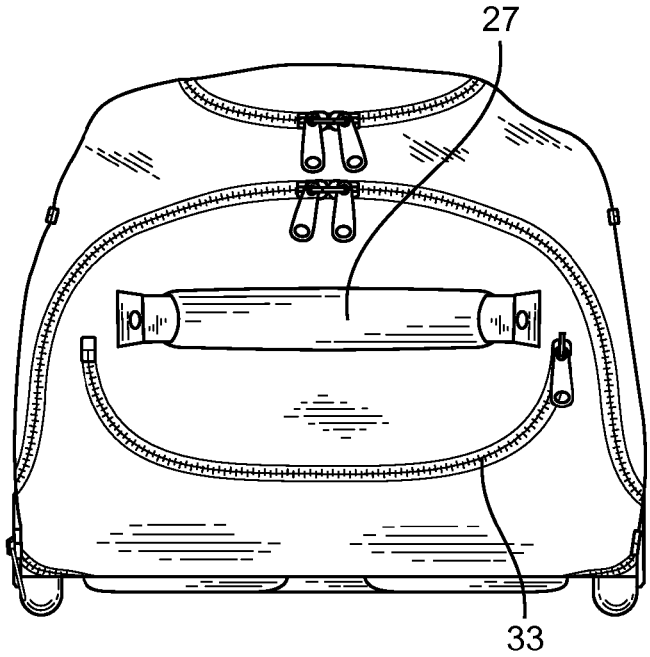
Figure 4:
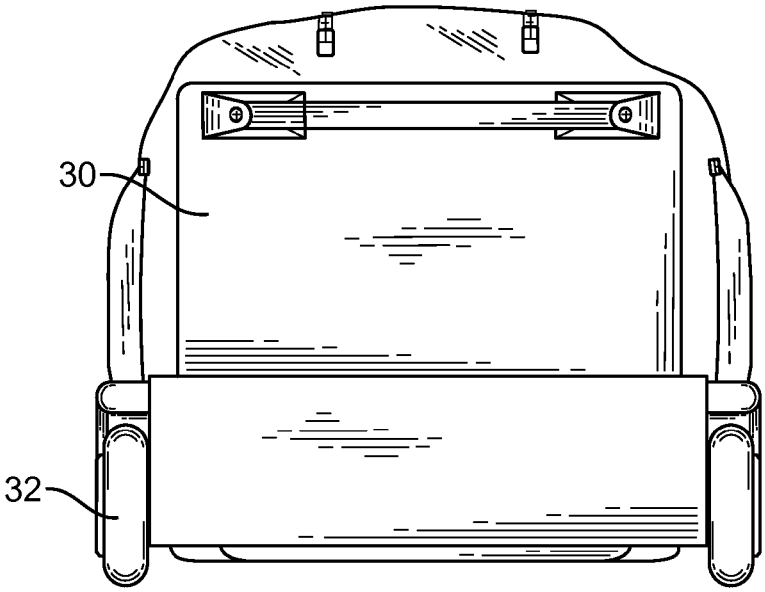
Figure 5:
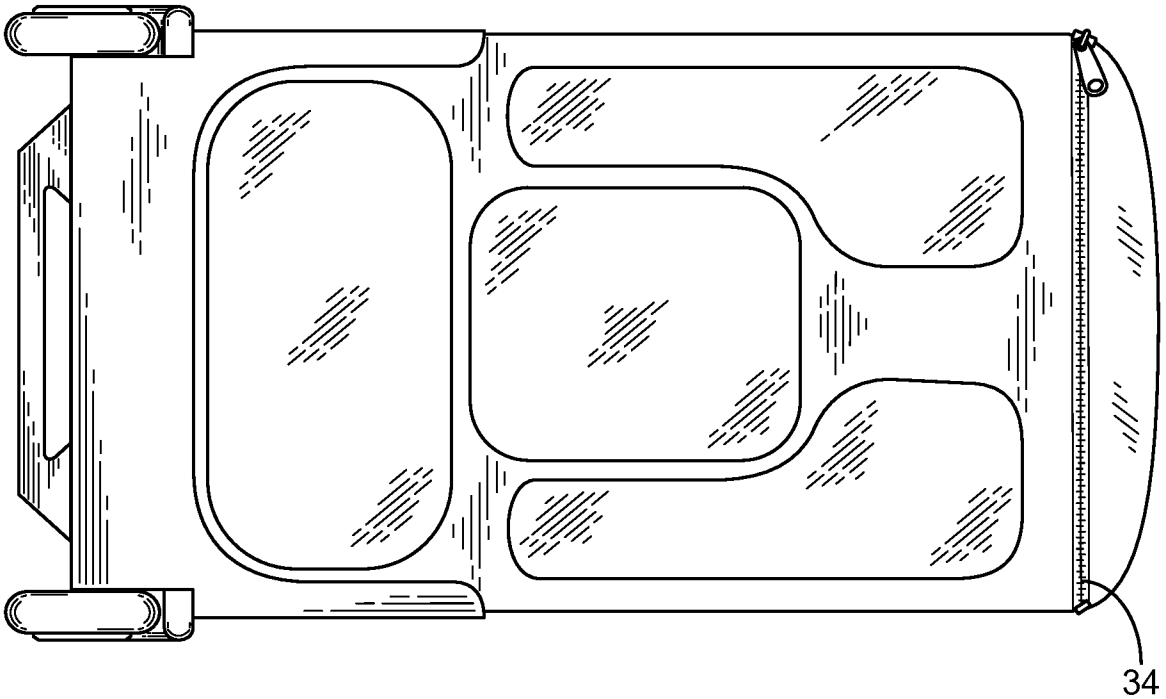
Figure 6:
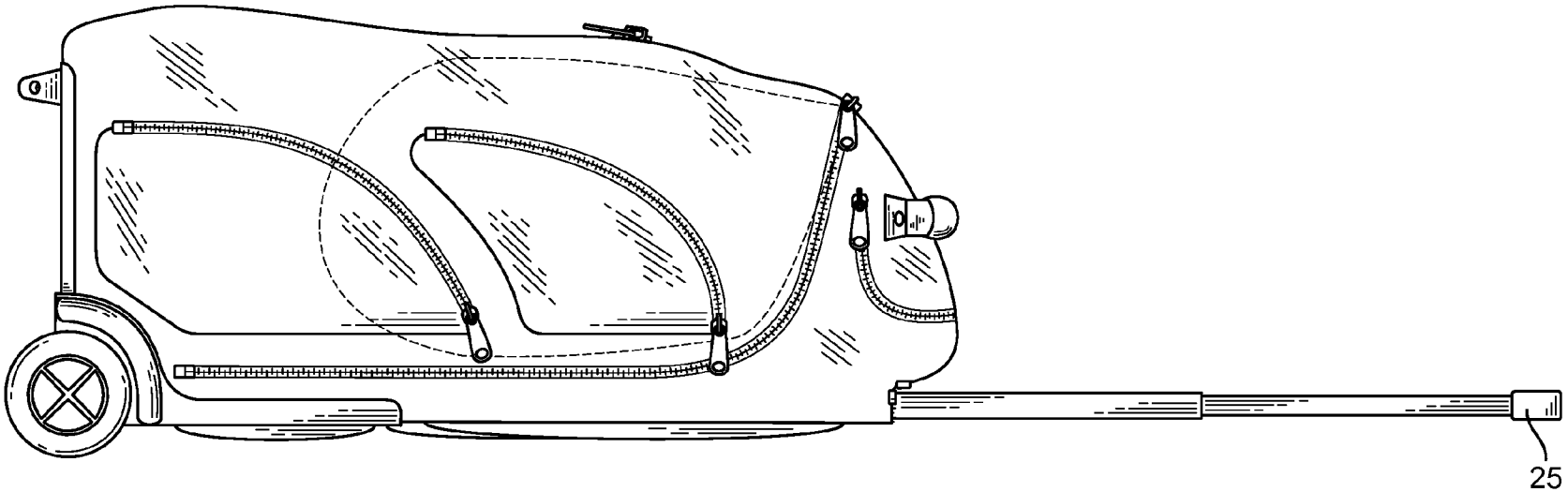

Referring now to the figures, a tailored, casual, soft and expandable bag (Xpanda Bag) used both as carry-on and check-in duffel luggage bag for occasions not limited to camping, sports event, travelling etc, incorporating the principles of the present invention has been illustrated in detail.

Xpanda Bag™ is an expandable bag product made of soft, flexible recycled or non recycled material that allows the invention to be used as a smaller carry on type bag with dimensions suitable for, but not limited to, carry luggage during mass transportation such as air or bus travel. The bag can be expanded when required to unfold into a larger check in type bag or duffel bag or luggage bag and then refolded to create a smaller bag as needed. The main thrust of the invention is giving the user flexibility during travel or life activities having one bag suitable for multiple uses and functions.

The drawings provided show the general shape and look of the bag emphasizing the actual enlarging and reducing process that includes zipper location, zipper tuck and fold, zipper location while in enlarged and reduced form, material location and position while folded and how the material is pleated and/or rolled, tucked or stuffed to allow the zipper and material to create a maximum expansion while the invention is expanded and a minimum space lost to the expansion material when the invention is in its' reduced form and the look of the invention while large, small, and while in transition form.

FIGS. 8 to 12 of the present invention disclose the major uses of the bag which may be used, but not limited to large "check in" luggage or duffle bag or suit case with wheels, extendable walking handle, and retractable straps. Further FIGS. 1 to 7 show the invention is also a small "check in" back pack designed to be more versatile as a "carry on" unit.

It is an embodiment of the present invention wherein the zip of the zipper along with the pleats and folds of the material is responsible for changing/converting the bag from smaller dimension to larger dimension and vice versa. The drawings explain the folding for this change and the look of the invention in either large or small format. The drawings further show the approximate location of each element while in either large or small versions. Manufacturing issues, sizes, and styles may change the exact location of these elements while retaining the integrity of the invention concept.

As best seen in FIG. 1 through 7 shows the expandable bag 10 of the present invention in its retracted position that can be used as a normal "carry on" bag. The bag is constructed throughout generally of flexible fabric material, recycled or non-recycled in nature, comprising of a top upper handle strap 27 for holding when used as a brief case. In an embodiment of the present invention, the bag comprises of various primary/main and secondary compartments serving as storage pockets closed by zipper 11, 11*a*, 20, 33 and 34 as shown in figures. It is a major aspect of the present invention wherein closing and opening of zipper 11 and 11*a* in association with pleats, folds and inverted and/or tucking material serves the main function and/or role in retracting or expanding the bag either as a carry on small luggage or as a large duffel luggage bag whichever is required according to the need.

Figure 7:
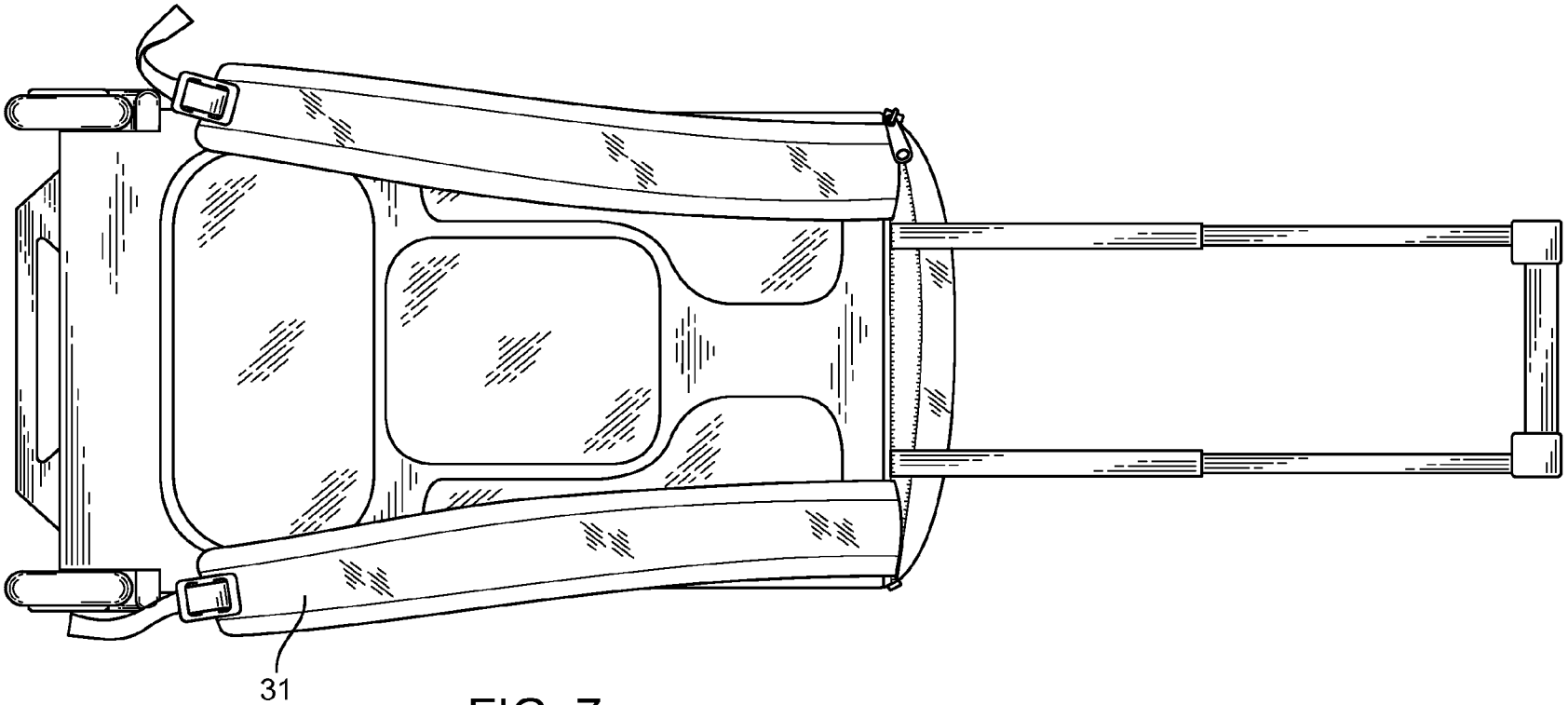

Additionally, the present invention may or may not comprise a strong bottom 30 with wheels for dragging purpose, made of harder, wear and impact resistant material if desired such as durable fiber, plastic, foamed polymer, acrylonitrile-butadiene-styrene (ABS) plastic, or of thicker sections of more flexible and less resistant materials or the like. Bag 10 can have long backpack shoulder straps 31 comprising inner sponge or foam material with upper end stitched to the body of the bag on the upper side and the bottom of the strap can be either stitched or connected with an adjustable buckle object that can enhance flexibility and comfort while carrying as shoulder backpack as shown in FIG. 7, when used for small volume luggage such as laptops, clothes and other low weight accessories required during travelling. Components of the bag are stitched in a proper and strong manner such that it can handle heavy loads when used as a duffel bag/check-in bag for larger amount of luggage.

It is an embodiment of the present invention wherein, recyclable materials such as polyethylene and polypropylene sheet material, polycarbonate sheet material, and carbon fiber sheeting may be used to reinforce the body, walls and bottom as necessary or desired, depending on the particular application and operating conditions.

In at least some embodiments, it may be advantageous if at least the walls and bottom have enough rigidity to hold their own shape, but that need not be the case in all embodiments. Secondly, the multi configuration of the expandable bag of the present invention is based mainly on the Zipping mechanism of the zippers that helps retracting and expanding the invention making it useful both as a "carry on" and duffel bag.

FIGS. 8 through 12 show the different embodiments of the present invention in expanded form with slide handle that supports the expanded form of the invention and also helps in carrying the luggage bag by wheels or dragger with ease. Also provided that zipper 34 basically serves as a storage pocket for sliding extendible handle 28 from which the handle can be extended out while carrying luggage supported by wheels.

Figure 8:
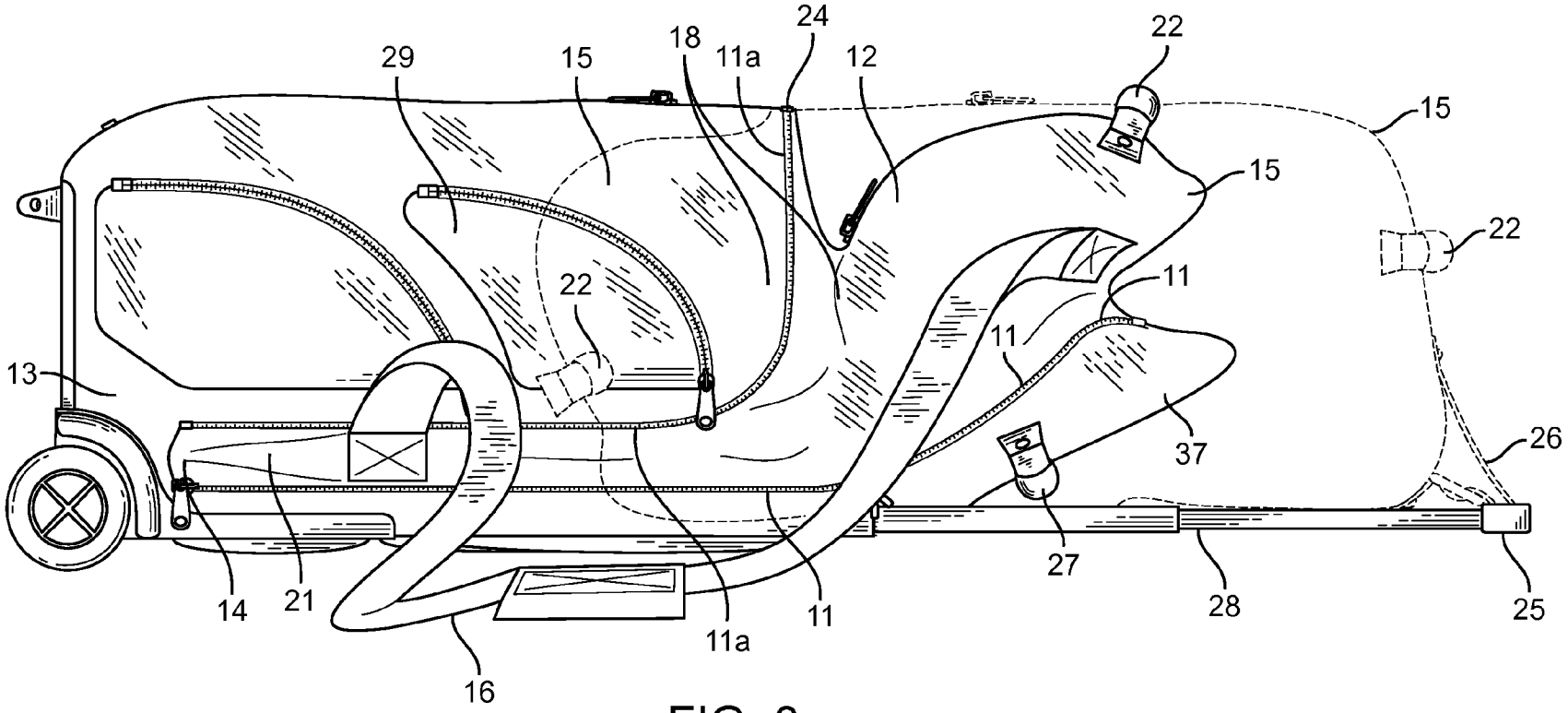
Figure 9:
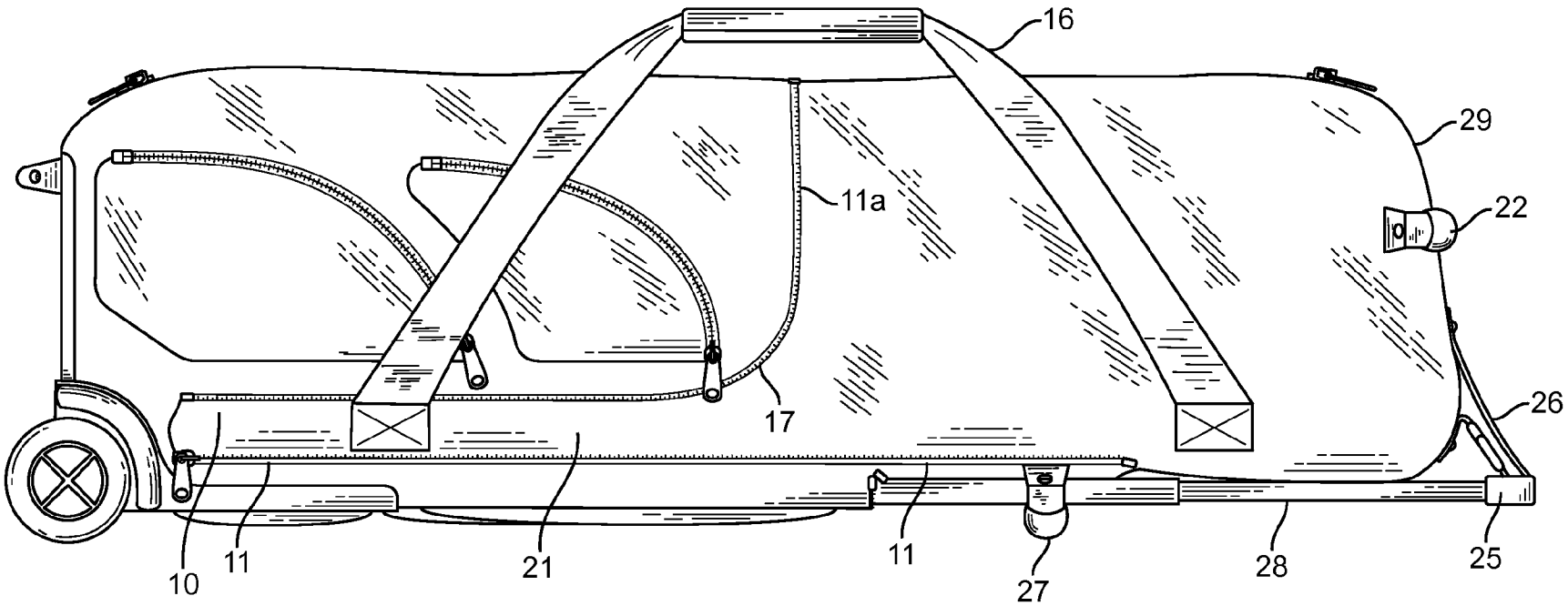
FIG. 9 Illustrates the invention in its fully extended and expanded condition FIG. 10 Illustrates the expanded front top view of the invention while face up FIG. 11 Illustrates the expanded back view of the invention while face down FIG. 12 General overview of the invention with the two size positions

The main component of the invention is depicted in the expanding and reducing of zipper 11, 11*a* with the inverting fold 12 and pleat 21 that accompanies this zipper as shown in FIGS. 8 and 9. Folding the flexible material and placing zipper 11, 11*a* at these fold points. Zipper 11, 11*a* can be seen separately on the front and the back of the bag while the bag is in its expanded form. In an embodiment, both these half zippers 11 and 11*a* that wrap around the length and width of the bag front and back respectively, along with the inverting fold 12 and pleat 21, are the main components of the invention that give it the uniqueness in transition from large to small and small to large and the unique form, function, look, application, and improvement on existing bags.

Referring to FIGS. 8 and 9 shows the bag 10 of the present invention in its partly and fully expanded form. The unique combination of zippers 11 and 11*a*, flexible material 15 with strap handle 22, inverting fold 12, pleat 21, sliding extension handle 25 and 28 are responsible in converting the retracted form of the bag 10 to expanded form.

In order to enlarge or reduce the size of the bag from its smaller form to its larger, the beginning point of the zipping process is point 14. Either a permanently joined zipper head or a head that separates at zipper head 13 can be used as shown in FIG. 8. Point 14 is the starting point of the zipper 11, 11*a* while retracting the bag to a small dimension and the ending point of the zipper 11, 11*a* while enlarging the bag.

Figure 10:
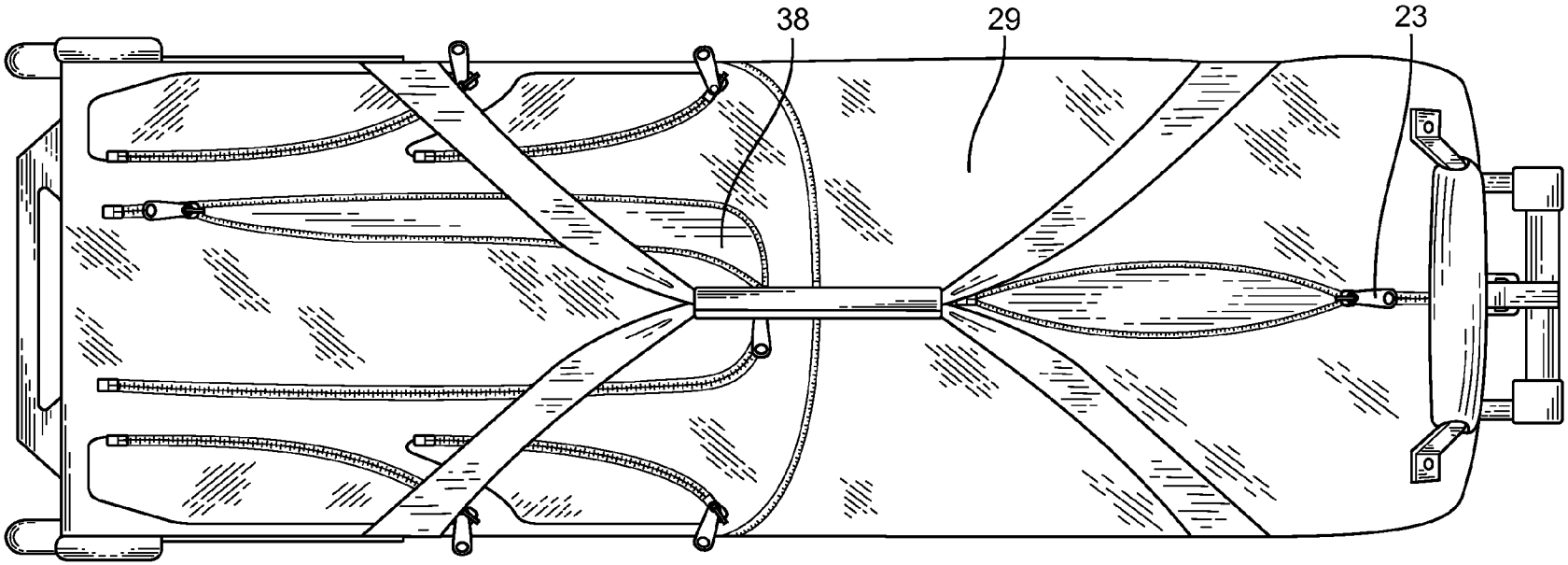
Figure 11:
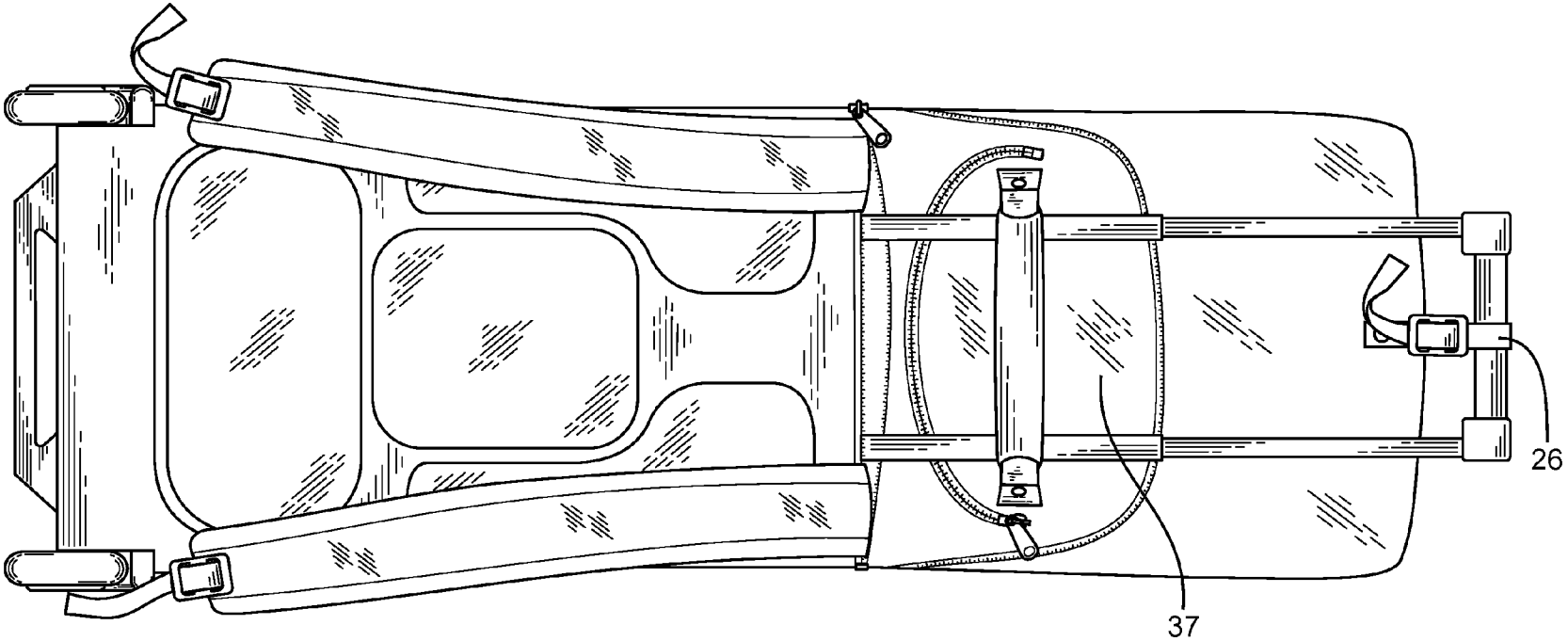

It is an embodiment during retracting the invention to a small "carry on" bag, the extension pleat material 15 that enlarges the height of the bag will be tucked into the bag as zipper 11, 11*a* begins its path to the top of the bag all the while tucking the pleat in as the zipping is proceeding. During this process, the optional long strap handle 16 will be tucked into the pleat while the zipping is proceeding. When inward tucking of the pleat 21, the long strap 16 and the zipping process reaches the top of the bag point 17 on both sides of the bag, the zipping and tucking of the lower portions of zipper 11, 11*a* temporarily stops. Strap 26 will be removed and slide handle 28 will be retracted through handle 27. Zipper 38 can be in the open or closed position as shown in FIG. 10. Zipper in its zipped form provides additional rigidity to the bag configuration and zipper 23 can be in the zipped position as this section may become an internal storage pocket. At this time the large duffle bag extension 15 will be tucked into the opening of the bag point 18 inverting the larger duffel bag into the now smaller bag. This will create the cavity or pocket 29 made out of the duffel bag extension 15 material. While the tucking in process is carried out, the duffel bag extension 15, upper portion of the long carry strap 16, the base side half of the bag extension and zipper 11 will fold and become the top flap of the convertible smaller bag meeting the top side half of the bag and zipper 11*a* where the zipping process stops at point 17 as shown in FIG. 8. Zipping of 11, 11*a* will now resume from point 17 until both zipper ends meet at the top most point 24 of the bag and zipper. The inverted duffle extension material 15 now sits inside the bag as a storage pocket accessed by zipping and unzipping 11, 11*a* but not exceeding point 17 of the zipper 11, 11*a* to keep the side pleats 21 and handle strap 16 from being released. The other access point of the bag includes zippers 20 as shown in figures. Zippers used in the present invention are quite durable in nature with strong teeth that enables easy zipping and unzipping mechanism.

Figure 12:
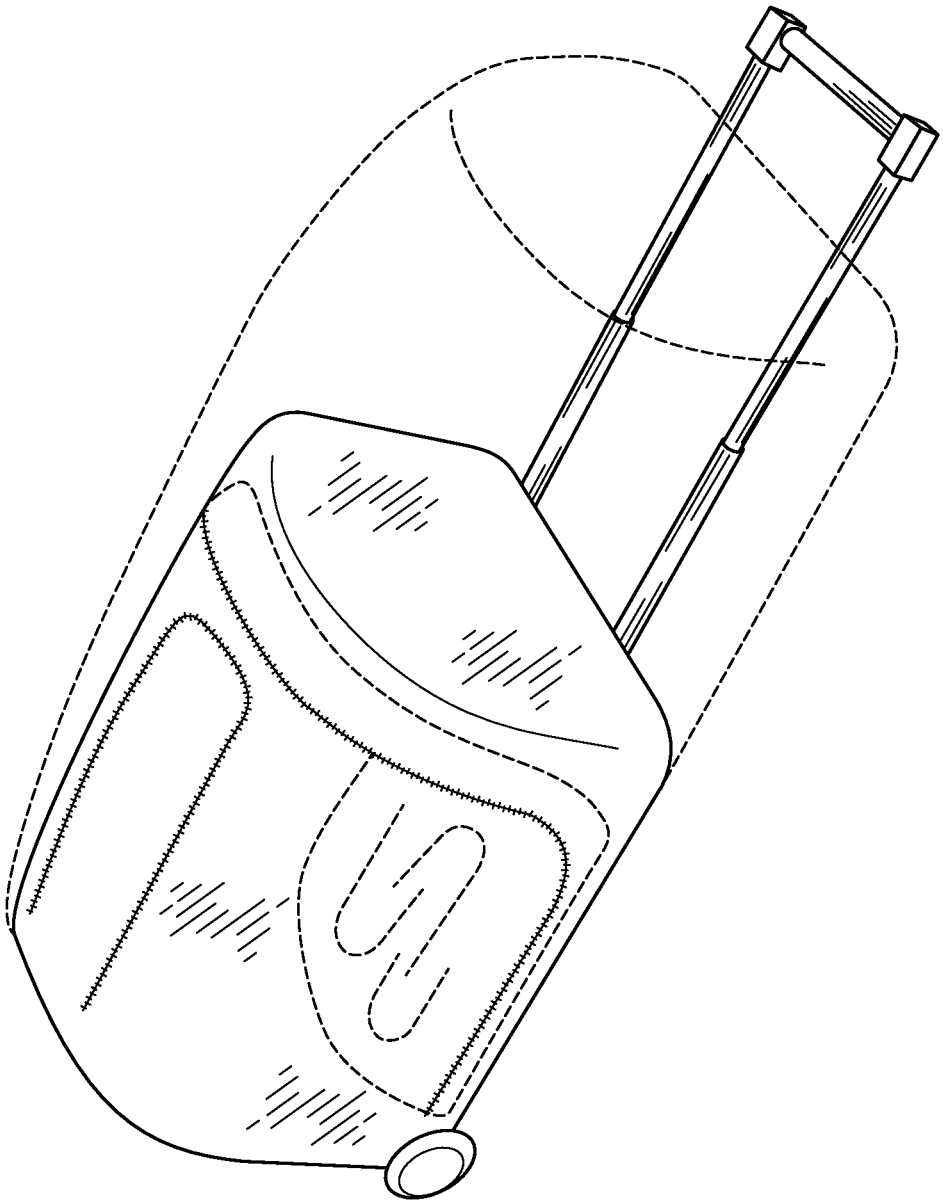

In another embodiment of the present invention, while expanding the bag from smaller configuration to larger configuration, as shown in FIG. 9, the zipper 11, 11*a* is simply unzipped completely until the zip of the zipper reaches point 14 or 13 of the bag. Inner pocket 29 is pulled outward by pulling the strap handle 22 to achieve a large bag form. As shown in FIG. 12, the pleat 37 along with strap handle 27 which forms the upper portion of the bag in retracted form will now align horizontally on the same plane of the bottom base of the bag thereby allowing complete outward expansion of the inner pocket 29. Extension handle 25 will then slide through handle 27 sliding to its full extension. Strap 26 will then be attached to slide handle 25 as seen, such that the whole expanded form of the bag rests firmly on the extendible slide handle 28 which acts as a support to the whole body. Tying of optional strap 26 onto the slide handle 25 also helps the alignment of the bag to be in a perfect position without causing any discomfort while carrying it as duffel luggage bag.

In an embodiment, strap 16 on both sides of the bag are joined together for easy holding/carrying purpose and also gives a good profile look to the bag. Joining of holding straps 16 is provided by using grip holding material or any other securing material. The extendable handle 28 can be used to support the bag when it is in its expanded position. This expansion and reduction process, fold, zipper, and their approximate locations, can be reproduced on various other sized and shaped bags. It is claimed that this fold style and zipper location is unique to this invention and is the primary distinction of the inventions uniqueness among these type of bags. 29 represents the approximate location and shape of the inverted bag once it has been adjusted to its reduced size as seen in FIG. 8. Zipper 20 and 38 will access to additional storage pocket unrelated to the expansion and reduction process. Once the bag is converted to its expanded form, it can either be dragged through wheels 32 by holding slide handle or it can also be carried as a large shoulder back pack case mainly during occasion like trekking or the like.

It is an embodiment that the bag of the present invention may or may not include pleats on the sides but only with extension material on the upper portion of the bag that would enable for expanding or retracing the bag according to the need. The bag of the present invention can be constructed in basically three sizes preferably small, medium and large dimensions. Possibly there are three ways to deal with the expansion material of the bag. Firstly, the expansion material can be simply tucked inward into the main body of the bag to form an inner storage pocket. Secondly, the expansion material can be tucked in under a material layer/skin at the bottom of the bag. The material skin/layer can be closed by zippers once expansion material is tucked inside it. Alternatively, the expansion material of the bag can be rolled up firmly towards the upper portion of the bag wherein it can be secured tightly by a adjustable strap to keep it in tucked in position. Whenever, the need arises to expand the bag, the adjustable strap can be easily loosened to un-roll or open up the expanded material.

It is further an important embodiment of the present invention that the actual zipper 11, 11*a* position within inches while in profile view. The 100% accurate location will rely on manufacturing issues that affect the actual zipper and fold location within inches. Bag style and size will nominally affect the 100% actual location and angle of the zipper 11, 11*a* and fold as well. The expansion material may be rolled, tucked, or otherwise used as a pocket as the need may be. A retaining strap may be included in the invention to retain a rolled version of the expansion material when in the unexpanded position, while a tucking pocket will be included to retain a tucked in version.

Advantages of the Invention

Xpanda Bag™ as an invention has several advantages:

1. The material used to increase and reduce the bag, are one in the same. The fold or the inversion process utilizes the material from the larger bag thus eliminating the extra material and weight of additional material. When the invention is in its smaller position, the material that was used for the larger position is utilized to create the top flap of the bag as well as one of the inner storage pockets.

2. The major component that reduces or increases the size of the bag is the function of zipper 11, 11*a* which is simple, easy to use. There are no mechanisms or hinges or difficult procedures to achieve this flexibility. Once the bag has been tucked to its inverted position, a simple zip on each side of the bag makes the change complete and sustainable. To enlarge the bag is extremely quick and simple as well.

3. The handle strap used while the invention is in its expanded position, is retractable and/or detachable and can be hidden in the zipper, tuck or pleat while the invention is in its reduced position.

4. The extendable handle 28 can be used to support the bag when it is in its expanded position. The extension handle 28 slides through handle 27 for further support.

5. The invention encompasses several products and functions all in one unit. This advantage is apparent in its function as a regular suit case type bag either as a "carry on" size bag or as a "check in" size bag. The invention can be rolled in either position. The invention may include backpack straps that can be tucked into a recess pocket should they not be required.

6. These straps are useful in either the small or larger versions of the invention making the invention into either a day backpack or a larger camping/hiking type backpack. This flexibility allows the consumer to choose repeatedly from one in the same bag the function required based upon their needs at a given moment. Thus the invention encompasses real life situations and needs to accompany the end user without compromising the quality of its form or function in any given position.

7. There will be great effort to utilize recycled materials in the construction of the bag.

Furthermore, in constructing the bag of the present invention, great care is to be taken to construct the zipper closure members in a manner which secures them with great strength to each bag section.

While the preferred embodiments of the invention have been illustrated and described, it should be understood that variations would be apparent to one skilled in the art. Accordingly, the invention is not to be limited to the specific embodiments shown in the drawings.

The invention claimed is:

1. An expandable luggage, comprising:

a bag, having, a bottom portion having dragger wheels, a top portion having a strap handle, a back portion having a slide handle adapted to slid-in and slid-out from a compartment configured on the back portion, a main body having a plurality of zipper and compartment arrangements, the bag with the bottom, top and back portions and with the main body defines a small bag form; and an additional bag material adapted to be disposed and configured in at least one of the zipper and compartment arrangement of the plurality of zippers and compartment arrangements on the main body of the bag, the at least one of the zipper and compartment arrangements adapted to be selectively close or open to retract or expand the additional bag material to expand the main body of the bag from the small bag form to define a large bag form, wherein the additional bag material and the slide handle are adapted to be extended to define the large bag form, and wherein the extended additional bag material is attached to the extended slide handle to be supported thereover to configure the large bag form.

2. The expandable luggage of claim 1, wherein the additional bag material comprises fold and pleat components disposed in the at least one of the zipper and compartment arrangements to operate in association with each other in retracting and expanding the bag.

3. The expandable luggage of claim 1, wherein at least one of the zippers and compartment arrangements of the plurality of zippers and compartment arrangements is coupled along the side portions of the main body of the bag to configure at least one storage compartment.

4. The expandable luggage of claim 1, the bag is made of flexible recyclable or non-recyclable material.

5. The expandable luggage of claim 1, wherein the bag in the small bag form is adapted to be used as a 'carry-on' bag, and the bag in the large bag form is adapted to be used as a 'check-in' bag, and wherein when the bag is used as the 'carry-on' bag, the additional bag material tucks in fold and pleat components thereof to create a top flap of the bag and at least one of the zippers and compartment arrangements of the plurality of zippers and compartment arrangements to configure an inner storage pocket of the bag.

6. The expandable luggage of claim 5, wherein the large bag form with the additional bag material comprises zippers for closing the top flap.

7. The expandable luggage of claim 1, wherein the strap handle configured on the top portion of the bag to be used while the bag is in the small bag form and when the bag is in the large bag form, the strap handle is configured to the slide handle to pass through it while carrying the large bag form.

8. The expandable luggage of claim 1, wherein the bottom portion comprises strong durable material to support the bag in a standing position, and wherein the dragger wheels are configured along with the strong durable material to drag the bag.

* * * * *